US008566987B1

(12) United States Patent
Burge

(10) Patent No.: US 8,566,987 B1
(45) Date of Patent: Oct. 29, 2013

(54) ANATOMICAL SEAT CUSHION

(76) Inventor: Robert S. Burge, Asheville, NC (US)

( * ) Notice: Subject to any disclaimer, the term of this patent is extended or adjusted under 35 U.S.C. 154(b) by 43 days.

(21) Appl. No.: 13/066,360

(22) Filed: Apr. 12, 2011

(51) Int. Cl.
*A47C 27/15* (2006.01)

(52) U.S. Cl.
USPC ..... 5/655.9; 5/653; 297/452.26

(58) Field of Classification Search
USPC ..... 5/655.9, 653, 730, 731, 740, 953, 935, 5/728; 297/461, 452.63, 107, 452.26
See application file for complete search history.

(56) References Cited

U.S. PATENT DOCUMENTS

| | | | | | |
|---|---|---|---|---|---|
| 1,934,918 | A | * | 11/1933 | Everson | 27/21.1 |
| 2,156,629 | A | * | 5/1939 | Hutchison | 297/452.25 |
| 2,765,480 | A | * | 10/1956 | Mueller | 5/640 |
| 3,145,054 | A | | 8/1964 | Sopko | |
| 3,222,694 | A | | 12/1965 | Schick | |
| 3,276,047 | A | * | 10/1966 | Emery | 5/654 |
| 3,305,878 | A | * | 2/1967 | Hellbaum | 5/653 |
| 3,749,442 | A | * | 7/1973 | Berg et al. | 297/312 |
| 4,132,228 | A | | 1/1979 | Green | |
| 4,571,763 | A | * | 2/1986 | Suzuyama et al. | 5/653 |
| 4,643,481 | A | * | 2/1987 | Saloff et al. | 297/452.25 |
| 4,819,288 | A | * | 4/1989 | Lowthian | 5/653 |
| 5,286,089 | A | * | 2/1994 | Goldman | 297/452.26 |
| 5,402,545 | A | | 4/1995 | Jolley | |
| 5,442,823 | A | * | 8/1995 | Siekman et al. | 5/653 |
| 5,513,402 | A | * | 5/1996 | Schwartz | 5/691 |
| 5,611,098 | A | * | 3/1997 | Skibik | 5/653 |
| 6,302,488 | B1 | | 10/2001 | Tanigaki | |
| 6,918,146 | B2 | * | 7/2005 | England | 5/653 |
| 7,533,941 | B2 | | 5/2009 | Saitou | |
| 2006/0185093 | A1 | * | 8/2006 | Yu | 5/653 |
| 2008/0216245 | A1 | | 9/2008 | Liners | |
| 2009/0079237 | A1 | | 3/2009 | Riondato | |

OTHER PUBLICATIONS http://www.prostatitis.org/?gclid=CLLxr6_w4qUCFaJI7Aoduhme2g, Apr. 12, 2011.
http://prostate-cushion.com/, Apr. 12, 2011.
http://prostatepillow.blogspot.com/, Apr. 12, 2011.
http://www.contourliving.com/p-230-freedom-seat-cushion.aspx, Apr. 12, 2011.

* cited by examiner

*Primary Examiner* — Robert G Santos
*Assistant Examiner* — Myles Throop

(57) ABSTRACT

A seat cushion configured to promote pelvic support and alleviate pressure in the parineal, rectal, and coccyx regions. An embodiment of the seat cushion comprises a foam base having one or more reinforcing layers patterned to shape compliance in said base. Another embodiment comprises a channel shaped in relation to the ischial tuberosity allowing specific support and pressure relief for pelvic regions. Other embodiments are described and shown. The resulting seat cushion promotes posture with seating comfort and may be of specific aid to patients suffering from Chronic Pelvic Pain Syndrome. Embodiments are described and shown that can be manufactured inexpensively from readily available materials and customized to accommodate a specific user's need.

11 Claims, 11 Drawing Sheets

FIG. 4B1
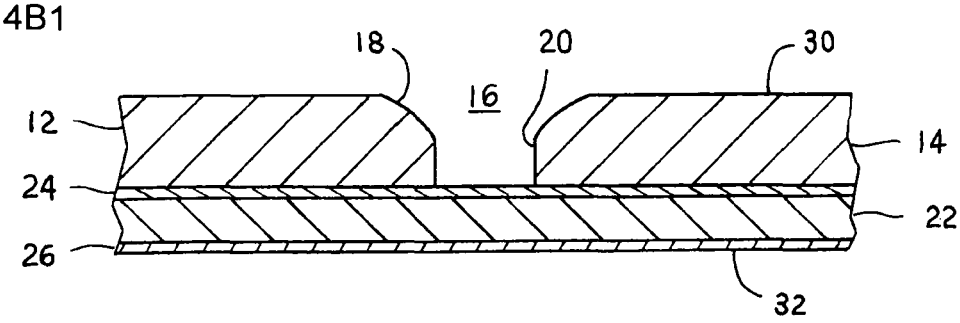
FIG. 4B2
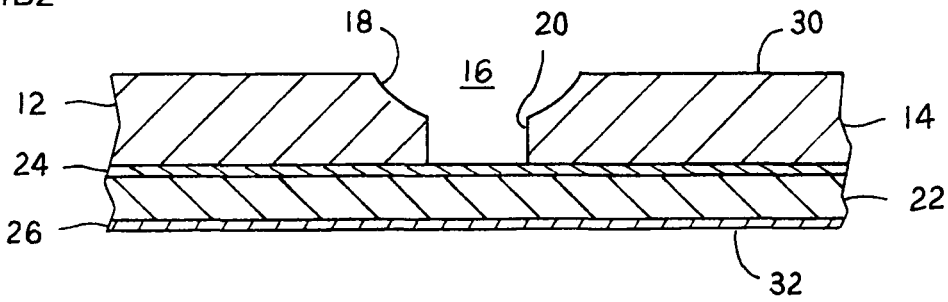
FIG. 4B3
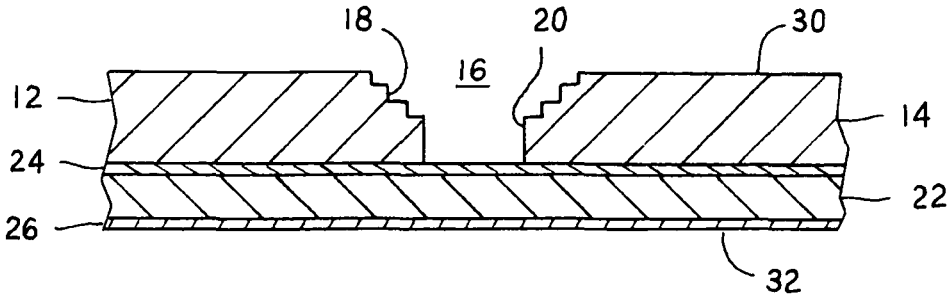

FloTex Foam
Load Force in Grams

| | 3 mm | 6 mm | 9 mm | 12 mm | % Change |
|---|---|---|---|---|---|
| Foam | 42 | 79 | 123 | 177 | |
| Tension | 89 | 167 | 256 | 368 | 209% |
| Compression | 124 | 182 | 236 | 286 | 197% |
| Both Sides | 157 | 293 | 448 | 616 | 360% |

FIG. 13

TPE Foam
Load Force in Grams

| | 3 mm | 6 mm | 9 mm | 12 mm | % Change |
|---|---|---|---|---|---|
| Foam | 107 | 173 | 228 | 303 | |
| Tension | 181 | 309 | 446 | 591 | 188% |
| Compression | 228 | 325 | 412 | 512 | 182% |
| Both Sides | 292 | 473 | 653 | 870 | 282% |

FIG. 14

Neoprene Foam
Load Force in Grams

| | 3 mm | 6 mm | 9 mm | 12 mm | % Change |
|---|---|---|---|---|---|
| Foam | 138 | 235 | 287 | 378 | |
| Tension | 303 | 501 | 658 | 845 | 222% |
| Compression | 409 | 561 | 669 | 767 | 232% |
| Both Sides | 599 | 883 | 1171 | 1481 | 398% |

FIG. 15

ANATOMICAL SEAT CUSHION

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND

1. Field of Invention

This invention relates to an anatomical seat cushion, specifically to such cushions used for orthopedic value.

2. Background

Many people suffer from pain in the rectal and perineal regions of the pelvis. Pain and discomfort stem from a number of causes such as hemorrhoids, rectal surgery or a damaged coccyx. Chronic Pelvic Pain Syndrome (CPPS) can be the source of substantial and prolonged pain. In men, it takes the form of Chronic Prostatitis (CP) and is the source of substantial sensitivity to pressure in the perineum.

In the book *A Headache in the Pelvis* authors David Wise, Ph.D. and Rodney Anderson M.D. describe the difficulties in living with Chronic Nonbacterial Prostatitis. "In men, chronic pelvic pain (prostatitis) includes pain in the rectum or perineum, between the scrotum and anus. Patients report that it feels as if there was a golf ball there." "All traditional treatments are largely ineffective in alleviating Chronic Nonbacterial Prostatitis." "The effect on a person's life with nonbacterial prostatitis has been liked to the effects of having a heart attack, having chest pain (angina), or active Crohn's disease (bleeding/inflammation of the bowels)."

The severity of this problem is defined in a National Institute of Health document *NIDDK Prostate Research Strategic Plan*. "Despite it's relatively high prevalence (estimates have ranged from 2.7 to 9.7 percent in men 18 years and older), prostatitis remains a poorly understood disorder and is very challenging to treat. Moreover, prostatitis, specifically in its chronic form CP/CPPS can be physically and psychologically devastating for many patients. For example, the QOL (quality of life) for a patient with chronic prostatitis has been reported to be similar to that experienced by patients with certain forms of heart disease or active Crohn's disease." "In the case of chronic prostatitis, there is virtually no understanding of the etiology or pathophysiology of disease and there are no prevention strategies or generally effective therapies."

Given the debilitating nature of Chronic Prostatitis and that it can persist for years or even throughout life, a cushion body that addresses all aspects of sitting discomfort is needed. Patients often find it desirable to sit in a more incline position shifting weight away from the perineum and further back on the ischia and buttocks. This increases pressure on the coccyx and lower sacrum, so an effective means to relieve this pressure is needed.

Persons experiencing rectal or perineal pain and discomfort often seat themselves on a donut-shaped cushion to prevent contact with and pressure on the affected area. Although relatively inexpensive, donut-shaped cushions do not provide a desired degree of relief. For example, in many cases donut-shaped cushions result in tension being exerted in the perineal region. Such tension can cause increased discomfort due to the contour surface pulling or compressing tissue. When centered to alleviate the perineum, donut-shaped cushions can concentrate pressure in the coccyx or genital area. Also, they tend to place the pelvis in abnormal positions making them an undesirable choice for prolonged use.

Another common means to alleviate pressure is a recess or channel along the centerline on the upper surface of the cushion body. This feature alleviates direct pressure along the interior of the pelvis to the extent that it resists deformation. The typical format is a channel formed by a straight line depression or recess. This general approach fails to accommodate to the specific form and function of the pelvic anatomy. It also fails to counter anomalies in pressure created by the underlying surface on which the cushion body is placed.

An alternative means to alleviate pressure is a slot or linear opening that breaches the cushion body. This approach structurally weakens the cushion body. The compressive force of a seated person is highest at the ischial tuberosity. Any opening between the ischia will allow the cushion body to separate and deform. A longer opening provides better accommodation to the user, but it will increase the tendency to separate. In general, a thinner cushion body is desirable, but this will increase separation and deformation.

Most cushion designs fail to account for the surface on which they are placed. When the shape of the cushion is important to its function, a rigid base is typically designed into the cushion body. Wood, plastic and steel are commonly used to form the base in many orthopedic cushion designs. A rigid base will force a specific shape, but it limits the cushion's use. For example, a rigid base is poorly suited to many vehicle seats that are specific in size and are bolstered along the sides. This approach negates many positive attributes found in a well designed seat.

What is needed is a seat cushion that provides effective isolation to the perineal, rectal, and coccyx area. One design requirement is the capability to substantially reduce direct and lateral pressure in the specified area. Another design requirement is the capability to control deformation in the areas between and forward of the ischia. A cushion body should be inexpensive to manufacture and use readily available materials. It should accommodate to a wide variety of every day seating, and provide proper pelvic support. It should function in complement with a well designed seat and not negate advantages.

SUMMARY

In accordance with one embodiment a cushion comprises a channel configured to a predetermined shape in relation to the ischial tuberosity relieving pressure in the perineal, rectal and coccyx regions of the pelvis.

In accordance with another embodiment a cushion comprises a foam base and at least one reinforcing layer patterned and bonded to said base forming a composite panel whereby compliance is shaped within said composite panel.

DRAWINGS

Figures

Figure 1:
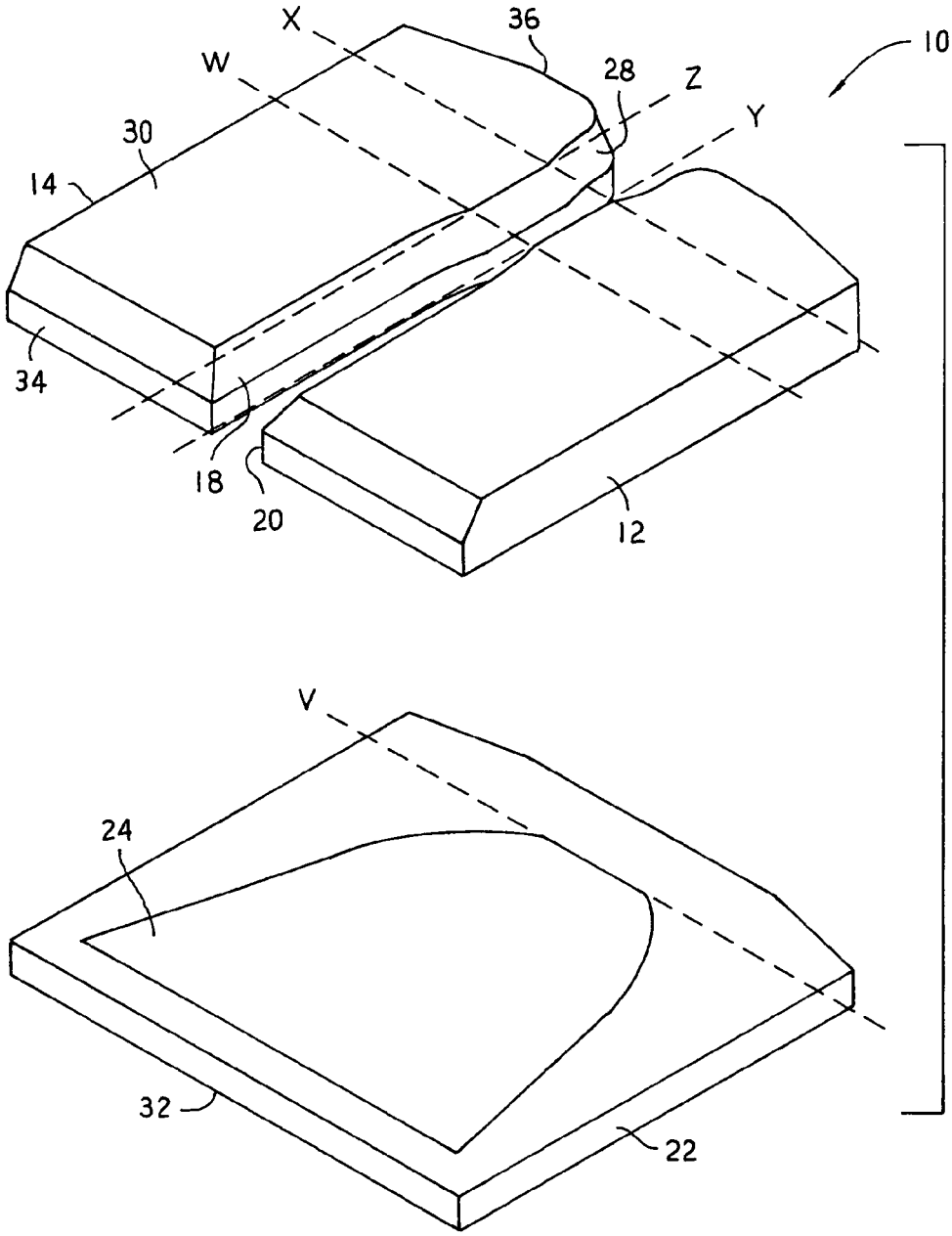
FIG. 1 is an exploded view of an embodiment of a seat cushion that is constructed in accordance with the invention.
Figure 2:
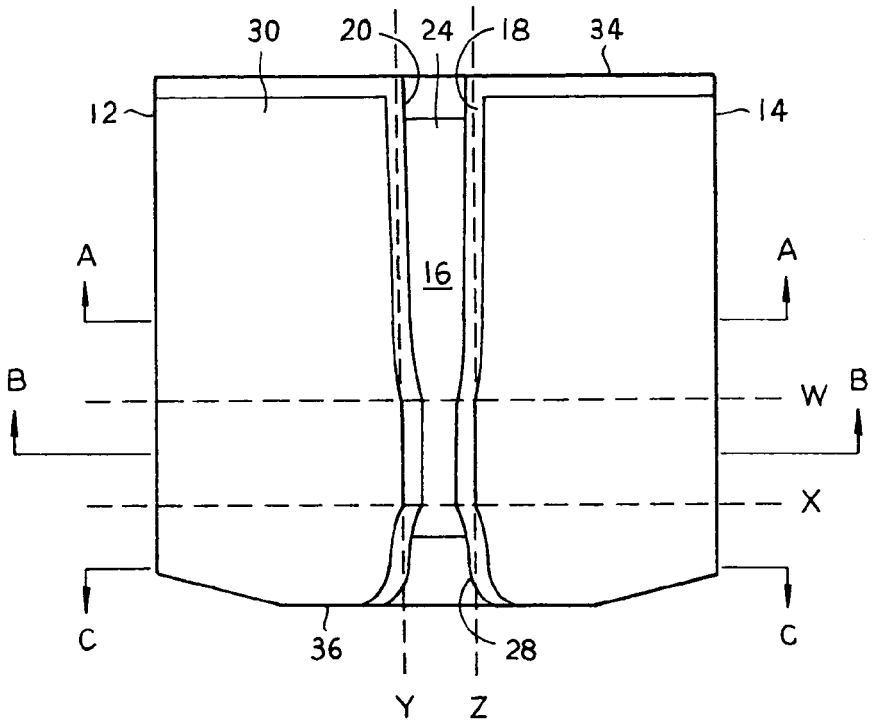
FIG. 2 is a top plan view of the cushion of FIG. 1.

FIGS. 4B1, 4B2 and 4B3 are partial, cross-sectional views of the cushion body as illustrated in FIG. 2 taken at line B-B in the direction of the arrows providing alternative embodiments.

Figure 5:
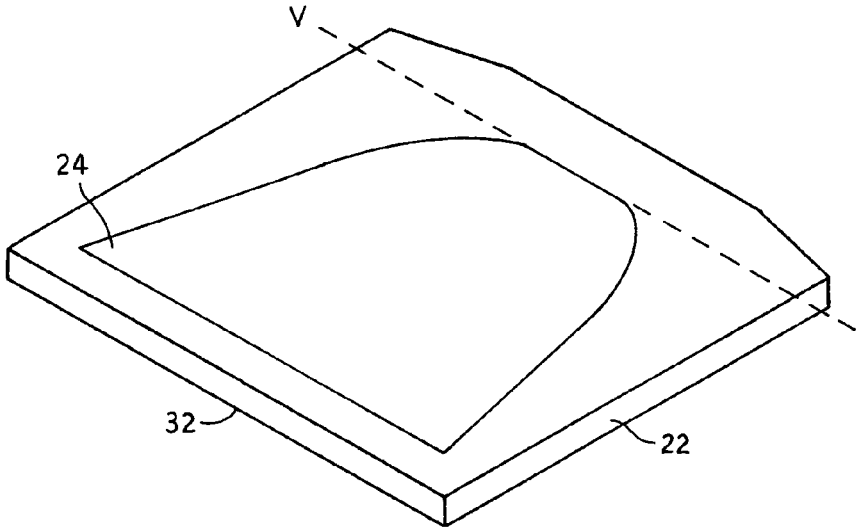

FIG. 5 is a top perspective view illustrating a base with upper reinforcing layer of the cushion of FIG. 1.

Figure 6:
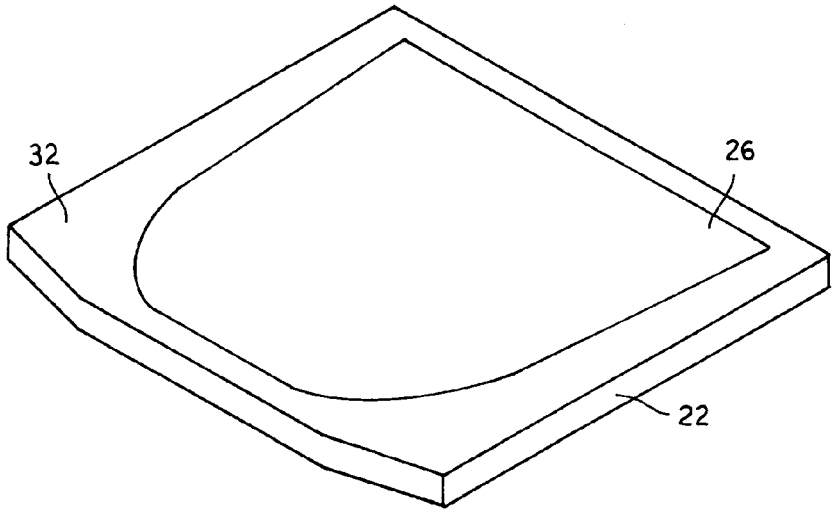

FIG. 6 is a bottom perspective view illustrating a base with lower reinforcing layer of the cushion of FIG. 1.

Figure 7:
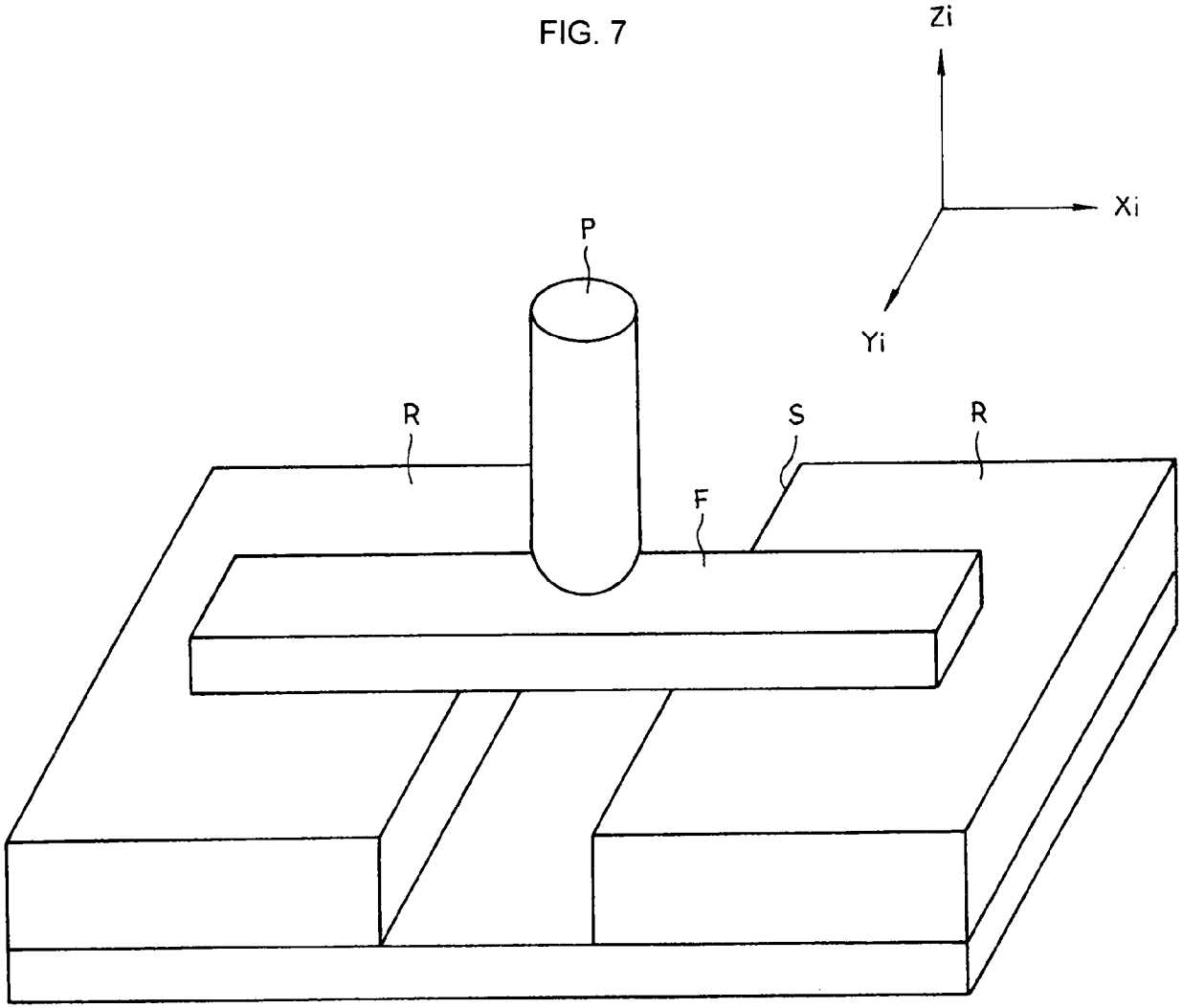

FIG. 7 shows a top perspective view illustrating an apparatus and method of measurement as defined below.

Figure 8:
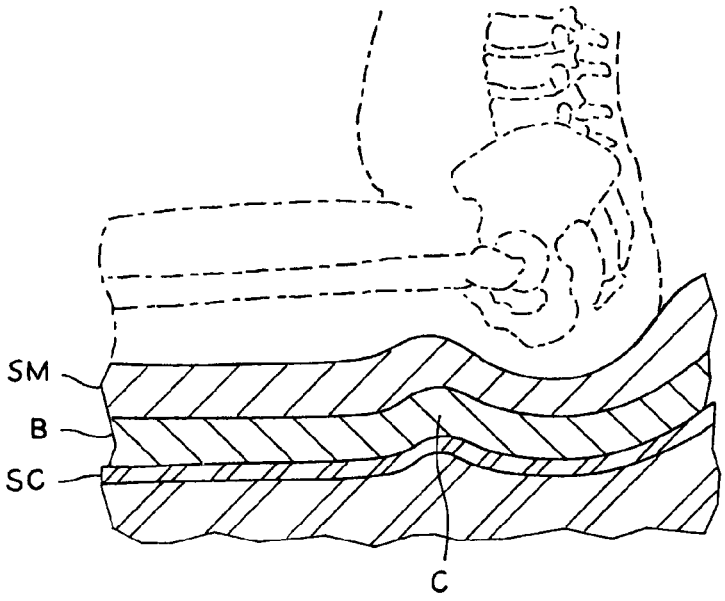

FIG. 8 is a cross sectional illustration of a cushion body in use showing a seated person and pelvic anatomy in phantom.

Figure 9:
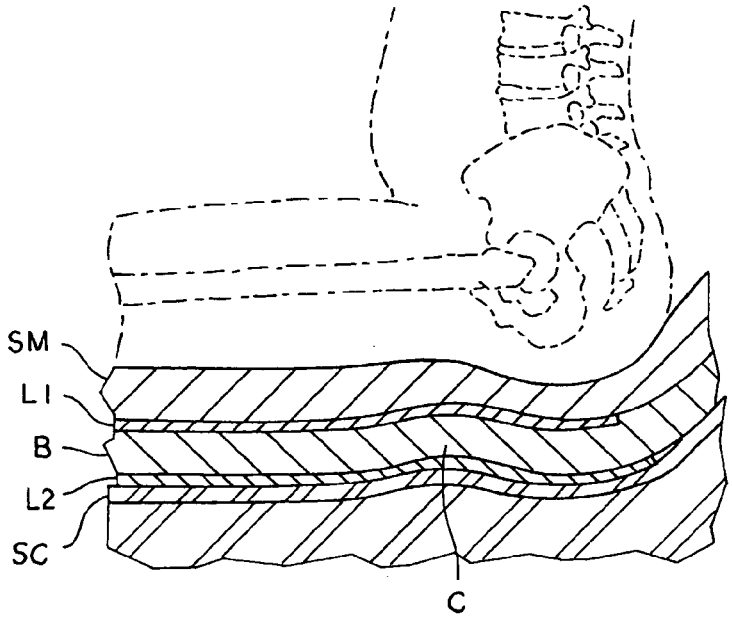

FIG. 9 is analogous to FIG. 8 and illustrates the effect of adding reinforcing layers.

Figure 10:
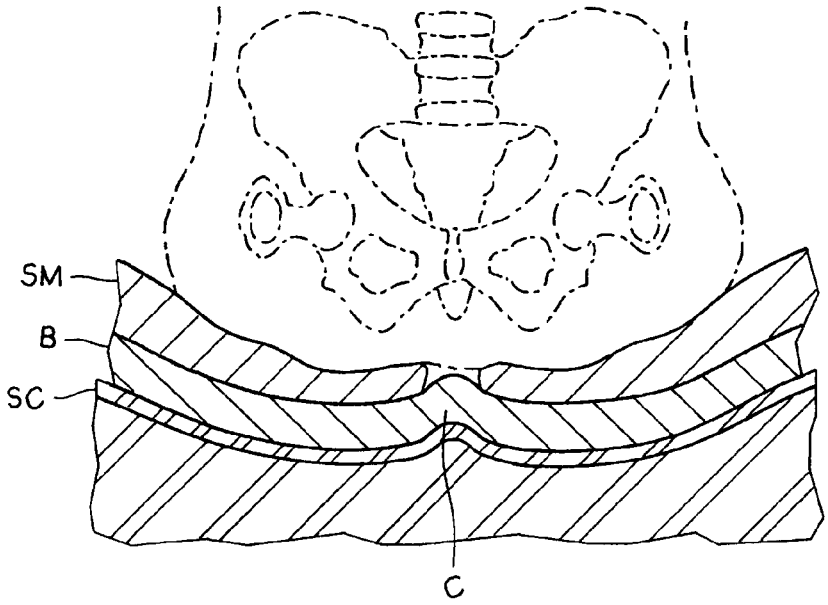

FIG. 10 is a cross sectional illustration of a cushion body in use showing a seated person and pelvic anatomy in phantom.

Figure 11:
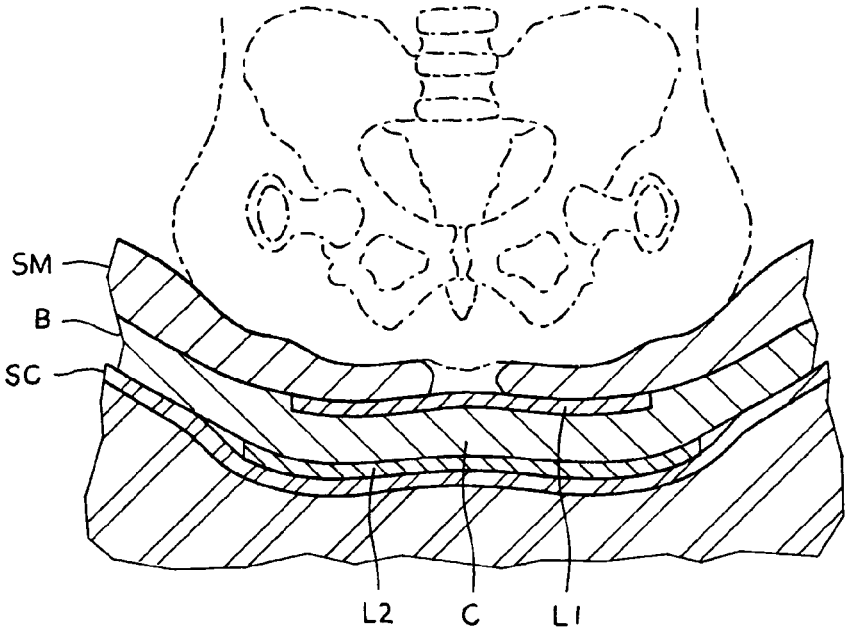

FIG. 11 is analogous to FIG. 10 and illustrates the effect of adding reinforcing layers.

Figure 12A:
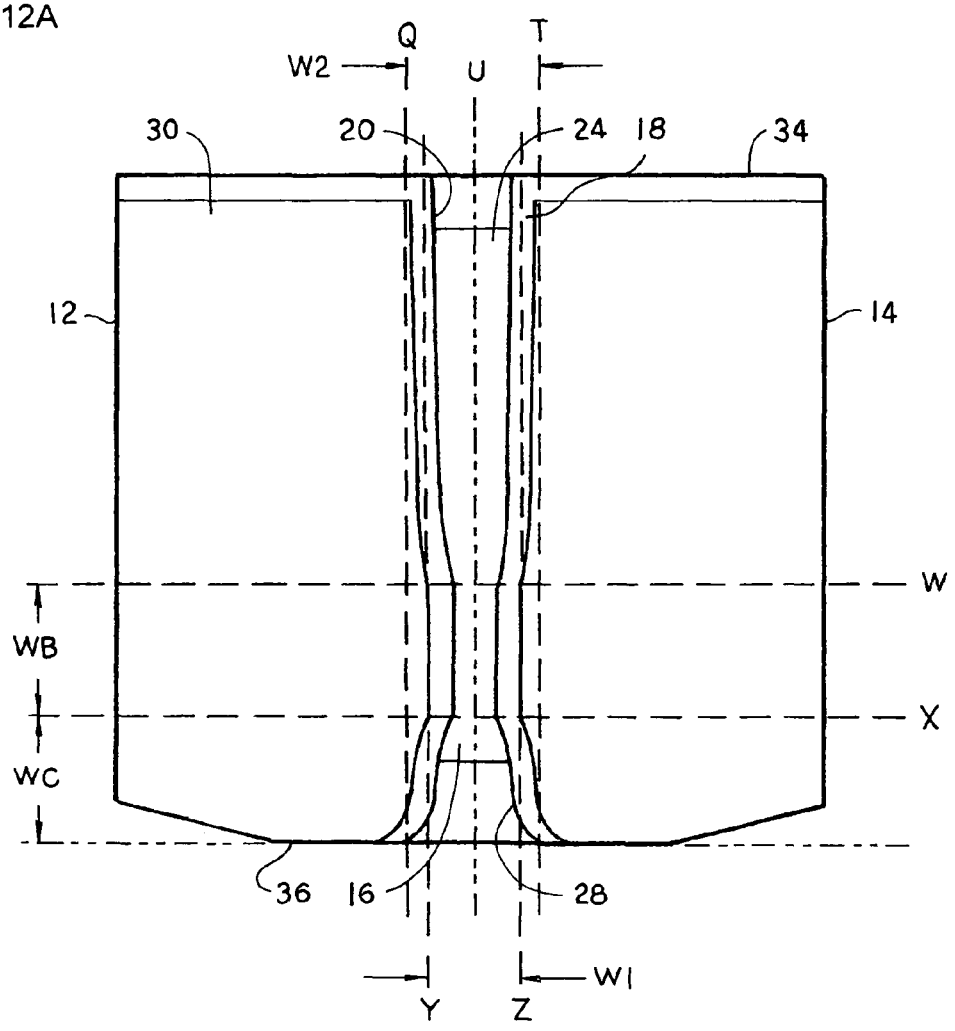

FIG. 12A is a top plan view illustrating performance characteristics.

Figure 12B:
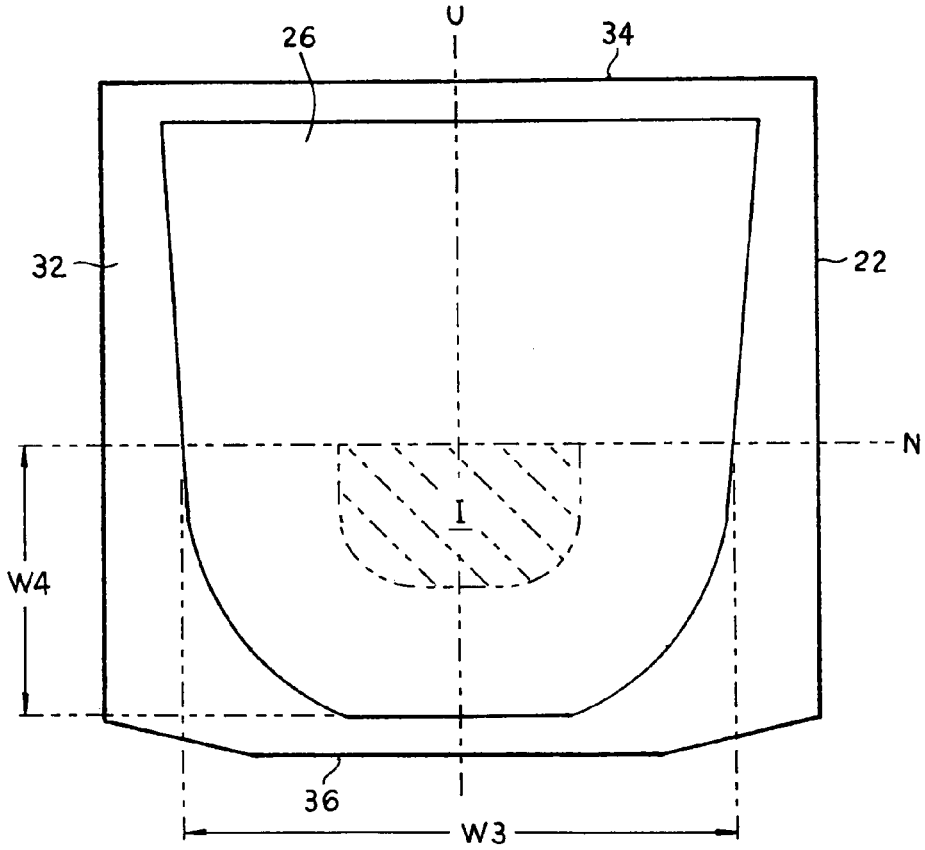

FIG. 12B is a bottom plan view illustrating performance characteristics.

FIGS. 13, 14, & 15 provide data relating load force in grams to deformation in millimeters.

DRAWINGS

Reference Numerals

| | |
|---|---|
| 10 | seat cushion |
| 12 & 14 | support members |
| 16 | channel |
| 18 | outer edge |
| 20 | inner edge |
| 22 | base |
| 24 | upper reinforcing layer |
| 26 | lower reinforcing layer |
| 28 | bell shape |
| 30 | top surface |
| 32 | bottom surface |
| 34 | front edge |
| 36 | rear edge |

DETAILED DESCRIPTION

FIG. 1 provides an exploded view of seat cushion 10 illustrating one preferred embodiment of the invention. Depicted are support members 12 and 14, base 22, and upper reinforcing layer 24. Lower reinforcing layer 26 is not shown in this perspective. These components are adhesively bonded to form a compressible, unitary seat cushion and comprise an embodiment of the invention.

Seat cushion 10 is of substantially rectangular geometry with base 22 and lower reinforcing layer 26 forming bottom surface 32. Base 22 is relatively flat allowing seat cushion 10 to be easily placed on a seating surface such as a chair, a sofa or a vehicle seat. Support members 12 and 14 form the top surface 30 of seat cushion 10 and are relatively flat allowing for accommodation of the buttocks and thighs. Support members 12 and 14 are separated by a space or gap that forms channel 16 running lengthwise from front edge 34 to rear edge 36. Channel 16 is configured to define a shape that substantially reduces or eliminates pressure in the perineal, rectal, and coccyx region.

FIG. 2 provides a top plan view of seat cushion 10 and illustrates the configuration of support members 12 and 14. In a preferred embodiment, support members 12 and 14 are made of open-cell foam. Support members 12 and 14 are proportional in size and shape and are generally symmetric as mirrored about the centerline of channel 16. Channel 16 comprises two intersecting surfaces creating an outer edge 18 and an inner edge 20.

Figure 4A:
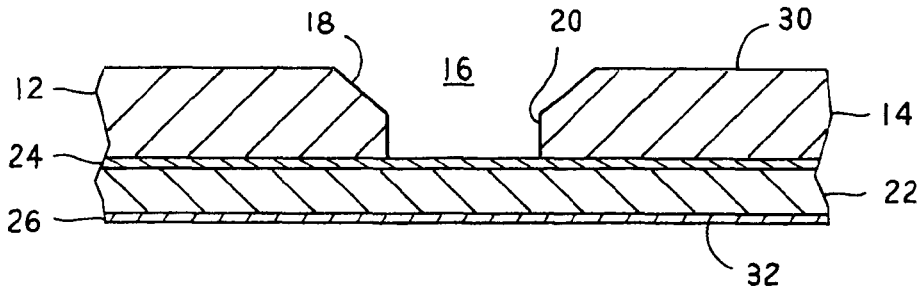
FIGS. 4A, 4B and 4C are partial, cross-sectional views of the cushion body as illustrated in FIG. 2 taken, respectively, at lines A-A, B-B, and C-C in the direction of the arrows.
Figure 4B:
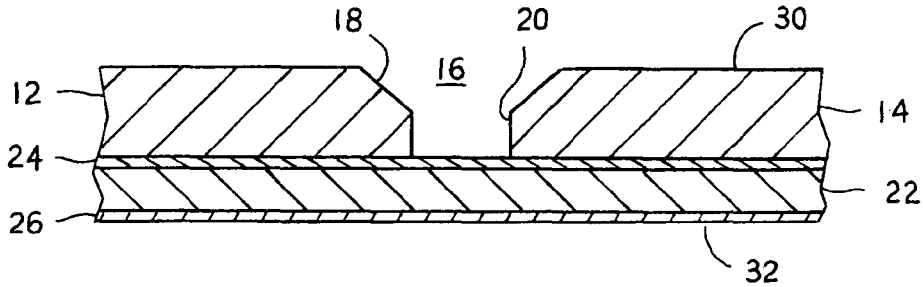
Figure 4C:
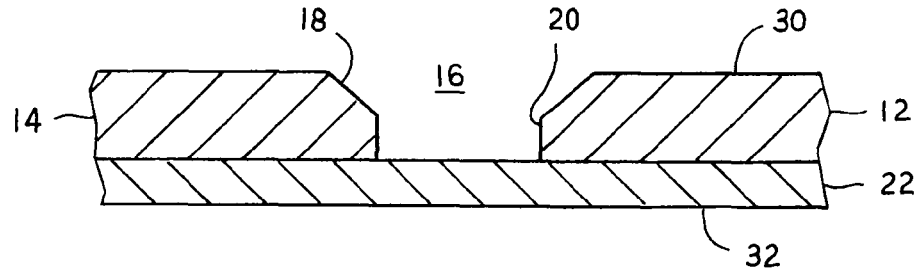

FIGS. 4A, 4B, and 4C are partial cross-sectional views of seat cushion 10 as depicted in FIG. 2 taken, respectively, at lines A-A, B-B, and C-C in the direction of the arrows. As illustrated in FIGS. 4A, 4B, and 4C, inner edge 20 is configured to run generally perpendicular to base 22 and upper reinforcing layer 24. Outer edge 18 is configured to lie along a slope defined by the points of intersection with top surface 30 and inner edge 20.

In the practice of the invention, channel 16 is configured in relation to the ischial tuberosity, and the following description assumes the user is seated on seat cushion 10 in a normal and generally upright position. In reference to FIG. 2, the shape and function of channel 16 is further addressed with respect to lines W, X, Y, and Z. As illustrated, channel 16 is partitioned in relation to lines W, X, Y. and Z. Lines Y and Z are arranged in parallel and are generally coincident with channel 16 within the section lying between the points of intersection with lines W and X. The width of channel 16 is generally indicated by lines Y and Z in the section between lines W and X, and this corresponds to the approximate location where outer edge 18 coincides with top surface 30. Line Y depicts a linear location lying approximately inside the left ischia, and line Z depicts a linear location lying approximately inside the right ischia. Lines W and X are arranged perpendicular to channel 16. Line W depicts a linear location lying approximately at the front of the ischium, and line X depicts a linear location lying approximately at the rear of the ischium. The section of channel 16 contained between lines Y and Z and lines W and X corresponds generally to the region beneath the pelvic arch and between the ischia.

In one embodiment, the position of lines W, X, Y, and Z can be ascertained by reference to anthropometric tables of measurements that predict a fairly specific region wherein a user's ischial tuberosity will likely sit. In another embodiment, the spacing between the ischial tuberosity together with the general placement of the ischial tuberosity within the cushion body may be measured for a particular user. The resulting measurements can be correlated to lines W, X, Y, and Z.

Forward of line W, channel 16 is configured to define a section that opens to approximate the perineal and genital region. The section of channel 16 extending rearward of line X comprises a generally bell shape 28 area approximating the coccyx and lower sacrum region. The bell shape 28 configuration substantially reduces pressure on the coccyx and point pressure on the sacrum along the rear of the channel.

Figure 3:
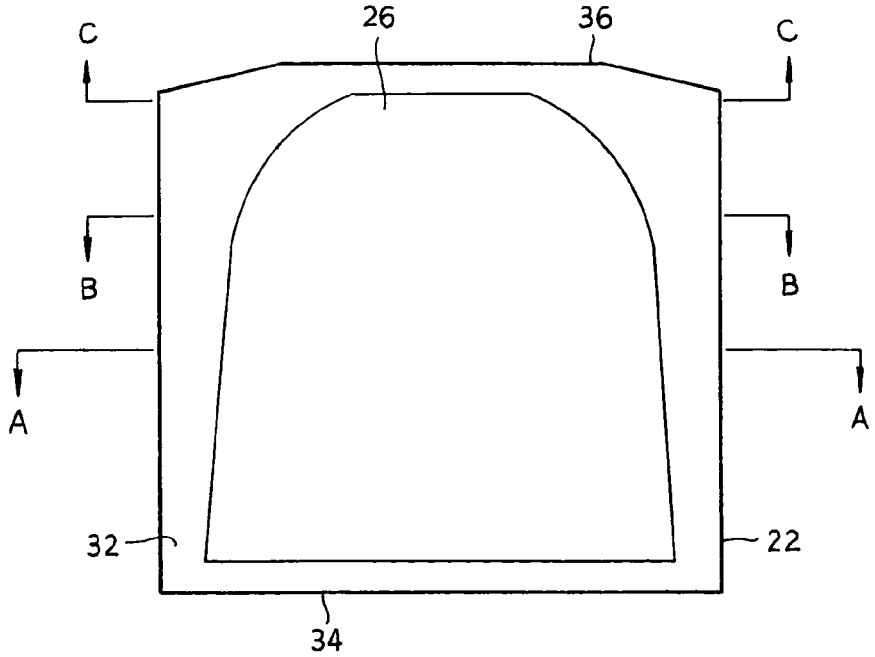
FIG. 3 is a bottom plan view of the cushion of FIG. 1.

FIG. 3 provides a bottom plan view of seat cushion 10 illustrating the configuration of base 22 with lower reinforcing layer 26. In a preferred embodiment, base 22 is made of closed-cell foam. Lower reinforcing layer 26 comprises a shape that generally underlies the user's buttocks and thighs whereby support for the pelvis is substantially increased.

FIGS. 5 and 6 illustrate one preferred embodiment of base 22 and a relationship between upper reinforcing layer 24 and lower reinforcing layer 26. Upper reinforcing layer 24 and lower reinforcing layer 26 are made of materials having significantly less elasticity than base 22. Examples of useful materials to construct the reinforcing layers are textiles such as synthetic or cotton canvas and plastic sheet as Mylar. These materials make no significant contribution to the thickness of seat cushion 10 while providing a substantial increase in relative stiffness, shape compliance, and the strength of the cushion body.

As illustrated in FIG. 5 upper reinforcing layer 24 is configured to substantially cover the area beneath the ischial tuberosity and fans out forward of the ischial tuberosity to cover the area beneath the thighs. Line V depicts a linear location lying generally behind the ischial tuberosity. Upper reinforcing layer 24 partially covers the first surface of base 22. Lower reinforcing layer 26 is configured to substantially cover the area beneath the buttocks and extends forward to cover the area beneath the thighs as illustrated in FIG. 6. Lower reinforcing layer 26 partially covers the second surface of base 22. Upper reinforcing layer 24 and lower reinforcing layer 26 are adhesively bonded to base 22 and form a laminate that is substantially stiffer and less flexible than the base 22 alone.

Operation and Function

Referring again to FIG. 2, the shape of channel 16 is configured to conform to the corresponding regions of the pelvic anatomy. Given that pressure is generally concentrated in the region of the ischial tuberosity, channel 16 contours around the ischia as illustrated in FIG. 2 providing substantial support for the ischial tuberosity. The section of channel 16 forward of line W opens to approximate the genital, perineal region increasing accommodation and substantially reducing pressure. Bell shape 28 section to the rear of the ischium accommodates the coccyx and lower sacrum region substantially reducing pressure in the region as the cushion body conforms and contours to the rear of the buttocks. The reverse curve formed along the base of the bell shape 28 at rear edge 36 substantially reduces point pressure in the sacrum region allowing the use of open-cell foam with greater index load deflection (ILD), increased firmness in the manufacture of support members 12 and 14.

In a preferred embodiment, channel 16 is defined by the converging surfaces of outer edge 18 and inner edge 20. Outer edge 18 forms a sloping surface dropping at an angle inwardly from top surface 30 to inner edge 20 and functions to release contact pressure progressively. This substantially improves user comfort and prevents the harsh feel of a more abrupt transition. The configuration of inner edge 20 provides a deep channel promoting air flow through channel 16 and improves oxygen transport into the open-cell foam of support members 12 and 14. Outer edge 18 may be extended around to the front edge of support members 12 and 14.

The ratio in proportion of outer edge 18 to inner edge 20 can be varied to accommodate the needs of the user. By minimizing outer edge 18, channel 16 can be opened up to more fully accommodate users with high sensitivity or swelling such as a hemorrhoidectomy, or pelvic surgery. More generally user comfort may be improved by increasing the width of outer edge 18 and configuring a slope that reduces an abrupt pressure transition at the channel. Furthermore by varying the width and depth of outer edge 18 forwardly and rearward of the pelvic arch, channel 16 can be opened up to accommodate the perineal and coccyx region. The chosen configuration for outer edge 18 and inner edge 20 can be matched to the application.

In the male, the anatomy of the perineal region contains the base of the penis with its component tissue structure. The corpora cavernosa and corpus spongiosum may be regarded as large cavernous veins containing the sponge-like erectile tissue of areolar spaces freely communicating with each other and filled with venous blood. Together with arteries, urethra, Cowper's gland, dorsal nerve, lymphatics of the penis, and associated tissue, it is understandable that the male perineal region can become sensitive to pressure. Immediately beneath and contiguous with this tissue is the prostate gland, and pressure in the perineal region can substantially aggravate chronic prostatitis.

As stated above outer edge 18 serves to control the transition of contact pressure within the channel and to substantially reduce point pressure along the channel edge. For example, it is generally not desirable to go from the high contact pressure on the ischial tuberosity to little or zero pressure in the perineum immediately. A simple rounded or chamfered edge can create localized or point pressure at the channel boundary. By moving the edge close to the ischial tuberosity localized pressure is moved to the outside region of the pelvic arch, but this approach leaves the perineal and rectal region unsupported causing stress in connective tissue. Moving the edge inwardly to better support the region within the pelvic arch can transmit pressure proportionately into sensitive tissue. Outer edge 18 of a predetermined shape can provide a progressive transfer of pressure whereby localization of pressure is substantially reduced. Various shapes are provided below and can be used in complement to achieve the desired pressure contour. A further advantage of outer edge 18 is to allow for a substantial increase in firmness with support members 12 and 14 improving overall support for the pelvis.

FIGS. 4B1, 4B2, and 4B3 illustrate alternative shapes for the configuration of outer edge 18. These shapes can be used in complement to control pressure transition within channel 16. For example, concatenating or blending a convex to a concave shape can create a pressure contour having greater firmness along the outside region of outer edge 18. The stepped approach can be used to vary the rate of change incrementally and worked well with routed prototypes. In the practice of the invention, the shape of outer edge 18 may be partly depended on a given manufacturing process for example molded, hot wire cut, or routed.

Referring again to FIGS. 5 and 6, the laminate formed by adhesively bonding reinforcing layers 24 and 26 to base 22 is substantially stiffer and more resistant to flex than base 22 alone. The composite formed by laminating a foam core between layers of textile or plastic sheet is more resistant to flex and deformation because the reinforcing layers force the foam core into compression and tension. The interaction of reinforcing layers 24 and 26 with base 22 creates a shaped compliance within the cushion body. The area defined by reinforcing layers 24 and 26 will be substantially more firm and supportive of the ischia and thighs. Outside reinforcing layers 24 and 26, the cushion body is more compliant conforming around the periphery of the buttocks. This shaped compliance works to support the primary load areas at the ischia and thighs tying them together and supporting a stable seating position while allowing the cushion body to conform around the buttocks shifting load to the outside and away from channel 16.

FIGS. 13, 14, and 15, provide measurements indicative of the general flexibility of a given closed-cell foam with respect to that closed-cell foam laminated with a given reinforcing material. The tabulated values are in gram load and indicate the gram force require to deform a given sample the specified amounts of 3, 6, 9, and 12 mm. FIG. 7 illustrates the measurement tool used to obtain these results. The measurement setup and arrangement of sample F are described in relation to the Xi, Yi, and Zi axis depicted in FIG. 7. The sample stage consists of two rails R arranged in parallel and separated by a space of 5 cm. The space creates a linear slot S with dimensions of 5 cm width and 2.5 cm depth depicted to lie in the Yi axis. The sample F consists of a foam strip placed on the stage and arranged perpendicular to and bridging slot S as depicted in the Xi axis. A cylindrical piston P is positioned directly above the sample F as depicted to lie in the Zi axis. The piston P is 2.5 cm in diameter with a hemispherical end of radius of 12.5 mm. The measurement is arranged so that the piston P is aligned to contact the center of sample F as aligned to the center of slot S. A measurement is made by applying force downwardly on the piston P causing the sample F to deform into the slot S and around the hemispherical end of piston P. The applied force in grams to deform the sample F by the specified amount is given in FIGS. 13, 14, and 15.

As grouped in FIGS. 13, 14, and 15, three types of closed-cell foam were evaluated. FloTex foam was obtained from foamorder.com and is specified as chloroprene elastomeric, medium firm foam similar to Airex closed-cell foam and certified by ULC (Underwriters Laboratory Canada) for flotation. TPE (Thermo Plastic Elastomer) foam is commonly used in yoga and exercise mats, and the TPE foam evaluated was purchased as an exercise mat from Wal-Mart. Neoprene foam was purchased from closedcellfoams.com. Neoprene is a flexible and spongy rubber available from many wholesalers. Sunbrella® canvas was used as a reinforcing material. Sunbrella® canvas is a registered trademark of Glen Raven, Inc. and available at many fabric retailers. Sunbrella® canvas was adhesively bonded to the closed-cell foam sample using 3M™ Supper 77™ spray adhesive.

Samples were prepared from closed-cell foam sheet approximately 12 mm in thickness. The sheet foam was cut into sample strips with dimensions of 2.5 cm width and 20 cm length. Sunbrella® canvas was cut into strips with dimensions of 2.5 cm width and 20 cm length to accommodate the dimensions of the foam samples for adhesive bonding.

Refer again to FIG. 7. First sample F, a foam strip, was measured using the above procedure relating gram load to deformation in millimeters. The results are given in FIGS. 13, 14 and 15 in the first row labeled Foam. Second, Sunbrella® canvas was adhesively bonded to one side of the sample F, and sample F was measured with the Sunbrella® canvas facing up and in contact with the piston P. The results are given in the second row labeled Tension. Third, the sample was measured with the Sunbrella® canvas facing down and in contact the stage rails R. The results are given in the third row labeled Compression. Fourth, a second strip of Sunbrella® canvas was bonded to the opposite side of the sample, and the sample was measured a final time. The results are given in the fourth row labeled Both Sides.

For the purpose of this document, stiffness will be defined as resistance to deformation in a material or material construct. Results provided in FIGS. 13, 14, and 15 are empirical, and the measurements provide a gage for stiffness in a given closed-cell foam relative to the change in stiffness achieved by adhesively bonding Sunbrella® canvas to one or both sides of the foam sample. The effect can be extrapolated to other foam products and to other materials that are generally elastic and compressible. In each case, the laminate of closed-cell foam with Sunbrella® canvas substantially increased the stiffness. By bonding Sunbrella® to one side of the closed-cell foam, the relative stiffness can be approximately doubled over that of the foam strip as indicated by the gram force required to deform the sample by the specified number of millimeters in rows Tension and Compression. With Sunbrella® bonded on both sides, the relative stiffness is generally increased by approximately three fold or better as seen in row Both Sides. The final column in each table is labeled % Change and is calculated by taking the percent difference between the average of all four gram load values in the first row (Foam) and the average of the four values in the corresponding row (Tension, Compression, or Both Sides). Percent change, % Change, compares the nominal value of the four load measurements on a given laminate and measurement configuration with the nominal value on the load measurements for the initial foam sample and indicates a relative percent change in stiffness.

By increasing stiffness in base 22, reinforcing layers 24 and 26 strengthen channel 16 against deformation. The inherent strength of materials like Sunbrella® canvas or plastic sheet like Mylar can substantially strengthen the cushion body against tearing and elongation. Further advantages of incorporating these materials into the design are illustrated as follows.

FIGS. 8 and 9 depict a partial cross-sectional view of a seat cushion like that defined by the invention and illustrate the cushion body in use. FIG. 8 depicts a cushion body consisting of a closed-cell foam base B with open-cell foam support members SM. The cushion body is depicted to be supported by an underlying cushion surface SC as typically found in a chair or vehicle seat. The ischium are the primary support structure in the pelvis when sitting and a region of maximum load and compressive force. Force of compression causes the cushion body to conform and contour around the surface of each ischia. The extent of contour around the ischia is proportional to the compliance and flexibility of the cushion body together with the compliance in the surface that supports it. As depicted in FIG. 8, contour C forms in front of the ischium and can transmit pressure laterally causing tension and stress in the perineal region.

FIG. 9 illustrates the addition of reinforcing layers L1 and L2 to the cushion body. As depicted in FIG. 9, reinforcing layers L1 and L2 reduce the compliance of the cushion body, and contour C is less pronounced reducing pressure transfer forward the ischium. In this configuration, reinforcing layers L1 and L2 can substantially reduce the transfer of pressure from the cushion body into the perineal region while allowing the cushion body to conform around the periphery of the buttocks.

FIGS. 10 and 11 illustrate how reinforcing layers L1 and L2 can significantly reduce the tendency for the cushion body to deform in the region between the ischia. FIG. 10 is analogous to FIG. 8 and depicts a cushion body consisting of a closed-cell foam base B with open-cell foam support members SM. As above the cushion body is depicted to be supported by an underlying cushion surface SC. Again, loading at the ischia creates a compressive contour C between the ischia in proportion to the compliance of the cushion body together with the compliance of any supporting surface. Deformation of the cushion body between the ischia can transmit into the channel reducing its effective depth and width resulting in a transfer of pressure into the rectal and perineal regions. FIG. 11 illustrates the addition of reinforcing layers L1 and L2 to the cushion body resulting in a substantial reduction in contour C and reducing the tendency for the channel to close. Thus, the channel is substantially strengthened against deformation allowing for greater control over its dimensions and better accommodation to the user.

The invention is further defined in terms of performance characteristics as illustrated in FIGS. 12A and 12B. FIG. 12A illustrates the configuration of channel 16 and depicts the proportional relationship between features through hidden lines. Line U depicts a centerline along seat cushion 10 running lengthwise from front edge 34 to rear edge 36. Lines Y and Z are arranged generally equidistant from centerline U and depict the approximate width W1 of channel 16 between lines W and X and within section B. A nominal range for W1 is approximately 12 mm to 160 mm. A preferable range for the W1 is on the order of 20 mm to 120 mm. One preferred embodiment comprises a range of 40 mm to 90 mm for W1.

Channel 16 is partitioned into three sections by lines W and X. Given section A lies forward of line W, section B lies between lines W and X, and section C lies rearward of lines X. Lines Q and T are generally equidistant from line U and approximate a boundary for channel 16 with respect to sections A and C. Width W2 indicates the span or spacing between lines Q and T. Width W2 is chosen to bound channel 16 with respect to the wider of section A or section C in the case where section A and section C are not generally equivalent in overall width. The reverse curve of channel 16 at rear edge 36, bell shape 28 may extend outside lines Q and T. W2 comprises a range that is greater than or approximately equal to W1. A nominal range for W2 is from W1 to 180 mm. A preferable range for W2 is on the order of W1 to 140 mm. One preferred embodiment comprises a range from W1 to 110 mm for W2. Forward of line W, channel 16 expands within W2 and is configured to comprise a generally parabolic area in one preferred embodiment.

Referring again to FIG. 12A, WB indicates the length across section B and the spacing between of lines W and X. Likewise, WC indicates the length of section C and the position of line X forward of rear edge 36. The nominal range for WB is approximately 25 mm to 160 mm. A preferable range for the WB is on the order of 40 mm to 130 mm. One preferred embodiment comprises a range of 50 mm to 115 mm for WB. The nominal range for WC is approximately 30 mm to 135 mm. A preferable range for the WC is on the order of 40 mm to 120 mm. One preferred embodiment comprises a range of 50 mm to 110 mm for WC.

The performance characteristics for outer edge 18 are given in relation to channel 16 width W1 and channel 16 overall depth. A combined width for outer edge 18 from both support members 12 and 14 is given as a percentage of channel 16 width W1. For clarity, said combined width for outer edge 18 is the sum of the widths for outer edge 18 from both support members 12 and 14 and comprises a percentage of width W1. The nominal range for said combined width for outer edge 18 is approximately 10% to 100% of W1. A preferable range for said combined width for outer edge 18 is on the order of 20% to 80% of W1. One preferred embodiment comprises said combined width for outer edge 18 ranging from 30% to 65% of W1.

In like manner, the depth of outer edge 18 is given as a percentage of channel 16 depth overall where the depth for outer edge 18 is taken at the point of intersection with inner edge 20 or in the 100% case the full depth of channel 16. The nominal range of depth for outer edge 18 is approximately 10% to 100% of channel 16 depth. A preferable range of depth for outer edge 18 is on the order of 20% to 80% of channel 16 depth. One preferred embodiment comprises a depth for outer edge 18 ranging from 30% to 65% of the depth of channel 16.

FIG. 12B illustrates further performance characteristic with respect to said reinforcing layers. Line U depicts a centerline along base 22 running lengthwise from front edge 34 to rear edge 36 analogous to FIG. 12A. Line N depicts a location just in front of the ischium and approximates a region where pressure transition is greatest. The position of line N forward of rear edge 36 will vary depending on user anatomy and seating geometry. An approximation for the location of line N is 180 mm forward of rear edge 36, and W3 and W4 are given relative to this value. Reinforcing layer 26 comprises an area at least sufficient to include the region generally underlying the ischial tuberosity as depicted in FIG. 12B by shaded area I. Reinforcing layer 26 is extensible comprising an area illustrated by W3 and W4 generally underlying the user. W3 depicts the width of reinforcing layer 26 with respect to line N. A nominal range for W3 is approximately 110 mm to 500 mm. A preferable range for the W3 is on the order of 134 mm to 440 mm. One preferred embodiment comprises a range of 162 mm to 360 mm for W3.

W4 indicates the extensibility of reinforcing layer 26 rearward of line N. A nominal range for W4 is from 70 mm rearward to rear edge 36 or 180 mm per line N above. A preferable range for W4 is on the order of 80 mm to rear edge 36. One preferred embodiment comprises a range of 90 mm to rear edge 36 for W4. Reinforcing layer 26 is extensible forwardly of the ischium comprising an area ranging from line N to front edge 34 whereby support for the thigh region is substantially increased. For shaped compliance, the surface area of the reinforcing layer is generally less than surface area of base. The performance characteristics described for reinforcing layer 26 can be generally applied to reinforcing layer 24.

A functional characteristic of said reinforcing layers is to significantly reduce material elasticity at the surface of base 22. Reinforcing layers described so far rely on a separate material bonded to the surface of base 22. Alternatively, a reinforcing material can be overlaid, dispensed, or applied to the surface of base 22 and bonded or incorporated by a curative means. In one prototype, neoprene based cement was used to produce a substantial change in elasticity by coating the surface of foam materials used to form base 22. A reinforcing layer can be incorporated into the surface volume of the base material whereby the chemical or physical makeup is changed reducing elasticity. A wide variety of adhesive means and materials will be evident to those skilled in the art. The bonding means used to affix the constituent parts need be at least sufficient to prevent de-lamination or separation in the normal course of use.

In the practice of the invention, various materials and methods of construction can be employed to produce a seat cushion that exhibits the desirable compressible, resilient qualities and conformal characteristics. Currently preferred embodiments of seat cushion 10 are formed by methods readily apparent to those skilled in the art. One suitable material for support members 12 and 14 is polyurethane foam. Channel 16 can be formed by molding polyurethane foam to the desired configuration. The curvature of channel 16 can be cut by any of a number of devices suited for such purpose. Effective prototypes have been produced with outer edge 18 and inner edge 20 cut by razor blade, hot wire, and high speed routing bit. The selection of components used in fabricating seat cushion 10 may be matched to the support requirements of the user and intended seating application.

One currently preferred embodiment of seat cushion 10 is comprised as follows. Support members 12 and 14 are made from polyurethane foam with thickness of approximately 2.5 cm having density on the order of 3.0 and ILD (index load deflection) on the order of 60. Base 22 is made of TPE foam with thickness of approximately 12 mm. Sunbrella® canvas is one of a group of textiles well suited for reinforcing layers 24 and 26. Another is Mylar approximately 10 mil in thickness. Referring again to FIG. 2, the location indicated by line W lies approximately 8.0 cm forward of line X, and line X lies approximately 8.5 cm forward of rear edge 36. The locations indicated by lines Y and Z are spaced approximately 6.5 cm apart. The spacing between support members 12 and 14 at inner edge 20 is approximately 3 cm where channel 16 lies between lines W and X. The depth of outer edge 18 to the point of intersection with inner edge 20 is approximately 50% the thickness of support members 12 and 14 or around 1.25 cm. Referring to FIG. 5, line V indicates a location approximately 6.25 cm from rear edge 36.

Another preferred embodiment comprises base 22 made of TPE foam approximately 12 mm in thickness and at least one reinforcing layer made from a strong textile as Sunbrella® canvas. An upper support layer comprises polyurethane foam approximately 2.5 cm in thickness with an ILD of 50. Channel 16 may be omitted relying on the shaped compliance of reinforcing layers to significantly improve pelvic support.

In another preferred embodiment, base 22 is made of semi-ridge EVA foam approximately 18 mm in thickness. Support members 12 and 14 are made of polyurethane foam having thickness of approximately 2.5 cm and ILD on the order of 60. Reinforcing layers may be omitted.

Another preferred embodiment comprises channel 16 molded into a cushion of extra firm polyurethane foam having a thickness on the order of 5 cm. Alternatively channel 16 may be routed into polyurethane foam sheet having density on the order of 3.0 and ILD on the order of 60. Channel 16 comprises a depth of approximately 2.5 cm with outer edge 18 utilizing approximately 40% of the full depth.

The above-described seat cushion 10 may be applied to any seat where the sitting position of a user is fairly well defined. Illustrative applications include: motorcycle saddles, automotive seats, industrial and agricultural motorized vehicles seats, theater seats, office chairs, airliner passenger seats, etc.

While this invention has been described in conjunction with the specified embodiments outlined above, it is evident that many alternatives, modifications, and variations will be apparent to those skilled in the art. Accordingly, the embodiments of the invention as set forth above are intended to be illustrative, not limiting. Various changes may be made without departing from the spirit and scope of the invention as defined in the following claims.

What I claim as my invention is:

1. A seat cushion, comprising:

a base member having a top surface and a bottom surface;

support members having a top surface and a bottom surface, a front end and a rear end, the support members configured to form a channel centrally located between the support members and within the seat cushion, the channel configured to run from the rear end to the front edge, the channel having an intermediate section with forward and rearward sections opening in width from the intermediate section, the transition from intermediate to forward section corresponds to the location of an ischial tuberosity of a person while the person is seated on the seat cushion; and at least one reinforcing means located adjacent to the top surface or the bottom surface of the base member, the reinforcing means configured to be symmetric in shape and uniformly positioned with respect to the channel, the reinforcing means comprises an area starting with an area of greater width forward the intermediate channel section contouring inwardly and rearwardly to terminate in the rearward channel section, the base member having a greater surface area than the reinforcing means;

wherein the anterior parts of the ischial tuberosity are capable of being centrally located within the seat cushion, and the bottom surfaces of the support members and at least the top surface of the base member and at least one reinforcing means being operatively interconnected to one another to permit the transmission of load forces from the support members to the base member and the reinforcing means.

2. The seat cushion of claim 1 wherein:

said base member is made of a foamed material.

3. The seat cushion of claim 1 wherein:

said reinforcing means is selected to include at least one of a group consisting of plastic sheet material, molded plastic material, textile material, double-sided adhesive sheet material, woven material, animal hide material, and fiber composite material.

4. The seat cushion of claim 1 wherein:

said support members are made of a foamed material.

5. The seat cushion of claim 1 wherein:

said channel is configured to a predetermined shape comprising, an intermediate section, a forward section having an opening curvature transitioning to a uniform width that extends to the front end, and a rearward section having an opening curvature transitioning to a reverse curve opening through the rear end.

6. A seat cushion, comprising:

a base member having a top surface and a bottom surface;

a support member having a top surface and a bottom surface, a front end and a rear end, the support member having a channel means formed in the top surface, the channel means configured to run centrally through the support member from the rear end to the front edge, the channel means having an intermediate section with forward and rearward sections opening in width from the intermediate section, the transition from intermediate to forward section corresponds to the location of an ischial tuberosity of a person while the person is seated on the seat cushion; and at least one reinforcing layer located adjacent to the top surface or the bottom surface of the base member, the reinforcing layer configured to be symmetric in shape and uniformly positioned with respect to the channel means, the reinforcing layer comprises an area starting with an area of greater width forward the intermediate channel section contouring inwardly and rearwardly to terminate in the rearward channel section, the base member having a greater surface area than the reinforcing layer;

wherein the anterior parts of the ischial tuberosity are capable of being centrally located within the seat cushion, and the bottom surface of the support member and at least the top surface of the base member and at least one reinforcing layer being operatively interconnected to one another to permit the transmission of load forces from the support member to the base member and the reinforcing layer.

7. The seat cushion of claim 6 wherein:

said base member is made of a foamed material.

8. The seat cushion of claim 6 wherein:

said reinforcing layer is selected to include at least one of a group consisting of plastic sheet material, molded plastic material, textile material, double-sided adhesive sheet material, woven material, animal hide material, and fiber composite material.

9. The seat cushion of claim 6 wherein:

said reinforcing layer is substantially less elastic than said base member and is compliant about the buttocks.

10. The seat cushion of claim 6 wherein:

said support member is made of a foamed material having at least one part.

11. The seat cushion of claim 6 wherein:

said channel means is configured to a predetermined shape comprising, an intermediate section, a forward section having an opening curvature transitioning to a uniform width that extends to the front of said support member, and a rearward section having an opening curvature extending to the rear of said support member.

* * * * *